US006581785B1

(12) United States Patent
Falkenstein

(10) Patent No.: US 6,581,785 B1
(45) Date of Patent: Jun. 24, 2003

(54) ADJUSTABLE TIRE STAND

(75) Inventor: Thomas Richard Falkenstein, Akron, OH (US)

(73) Assignee: Albert Screenprint, Inc., Norton, OH (US)

( * ) Notice: Subject to any disclaimer, the term of this patent is extended or adjusted under 35 U.S.C. 154(b) by 0 days.

(21) Appl. No.: 10/045,527

(22) Filed: Jan. 15, 2002

(51) Int. Cl.[7] ..... A47F 7/04

(52) U.S. Cl. ..... 211/24; 211/72; 248/149; 248/152; 248/316.4

(58) Field of Search ..... 248/146, 149, 248/150, 152, 346.3, 174, 316.4, 346.06, 346.07, 228.3, 229.12, 229.22, 231.41, 154; 211/23, 24, 72, 73; 206/395

(56) References Cited

U.S. PATENT DOCUMENTS

| | | | | | |
|---|---|---|---|---|---|
| 1,250,937 | A | * | 12/1917 | Achert | 211/24 |
| 1,284,260 | A | * | 11/1918 | Doering | 211/24 |
| 1,405,505 | A | * | 2/1922 | Doering | 211/23 |
| 1,428,223 | A | * | 9/1922 | Fairbanks | 211/24 |
| 1,750,575 | A | | 3/1930 | Cubberley | 221/43 |
| 1,750,576 | A | | 3/1930 | Cubberley | 221/43 |
| 2,051,448 | A | | 8/1936 | Johnson | 221/43 |
| 3,298,121 | A | * | 1/1967 | Wathen | 211/24 |
| 3,510,007 | A | * | 5/1970 | Walklet et al. | 211/24 |
| 4,106,735 | A | * | 8/1978 | Partain et al. | 211/43 |
| 4,496,127 | A | | 1/1985 | Nelson | 248/441.1 |
| 4,671,404 | A | * | 6/1987 | Wall et al. | 206/45.24 |
| 4,802,708 | A | * | 2/1989 | Vos et al. | 114/363 |
| 4,856,659 | A | | 8/1989 | Krebs | 211/24 |
| 5,295,648 | A | * | 3/1994 | Hames | 248/149 |
| 5,368,266 | A | * | 11/1994 | Allen | 248/231.141 |
| RE35,677 | E | * | 12/1997 | O'Neill | 248/316.4 |
| 5,749,475 | A | * | 5/1998 | Krebs | 211/175 |

* cited by examiner

*Primary Examiner*—Ramon O. Ramirez
*Assistant Examiner*—Jon Szumny
(74) *Attorney, Agent, or Firm*—Reese Taylor

(57) ABSTRACT

A display apparatus for displaying an article such as a pneumatic tire includes an elongate base with a substantially planar top surface and article support members projecting from said top surface at opposed ends of the base. Opposed side or lateral article support members are also provided each having an elongate side wall for supporting the article and connection means are provided projecting from opposed ends of each of the side article support members for removable and adjustable inner connection with the article support members on the base to provide a display for displaying an article such as a pneumatic tire in a vertical position and with the ability to accommodate different sizes of tires.

4 Claims, 4 Drawing Sheets

ADJUSTABLE TIRE STAND

RELATED PATENT APPLICATIONS

None.

FIELD OF THE INVENTION

This invention relates, in general, to stands for supporting and displaying articles of merchandise and relates, in particular, to an adjustable stand for displaying pneumatic tires at the point of sale.

DESCRIPTION OF THE PRIOR ART

It is well known in the general merchandising field to display an actual article at the point of sale and to display it in the most attractive manner, preferably in a way in which the display closely resembles the actual article when it is in use. Typically the display itself also presents advertising material regarding the product.

In the specific field of pneumatic tire sales for trucks, automobiles and other vehicles it is likewise common to provide a point of sale display which is capable of presenting a tire in an upright or vertical position much as it would appear when installed on the vehicle.

These display stands generally provide a floor mounted base support which presents the tire in this fashion with a portion of the sidewall or shoulder also being supported, while a substantial portion of the sidewall of the tire remains visible. The sidewall generally displays the trademark or trade name of the manufacturer and various technical details regarding the tire itself while the side supports for the tire may also present advertising or promotional material.

Such display stands conventionally provide a vertical planar surface on at least one side wherein it is possible to display the advertising material and frequently a center piece is also placed within the center of the tire where the wheel normally would reside to carry additional information or advertising. An example of such a display can be seen in Krebs U.S. No. Pat. 4,856,659.

It has been found, however, that improvements can be made on this basic concept.

First, the cost of the displays is fairly high and it is believed that the desirable characteristics of the display can be achieved by providing a display made of a material which is relatively inexpensive yet strong enough to support the article or tire.

Second, it is believed desirable to provide an adjustable device. Inasmuch as the tire dimension from sidewall to sidewall varies depending upon the particular tire involved, it is desirable to render the display adjustable to accommodate such variances in width.

Finally, it is believed desirable to provide such a display which can be shipped from the manufacturer to the user in a flat condition and assembled in a few simple steps at the point of use thereby producing a saving in shipping and storage costs.

Accordingly, production of an adjustable tire stand of the character above described becomes the principal object of this invention with other objects thereof become more apparent upon a reading of the following brief specification considered and interpreted in view of the accompanying drawings.

Figure 5:
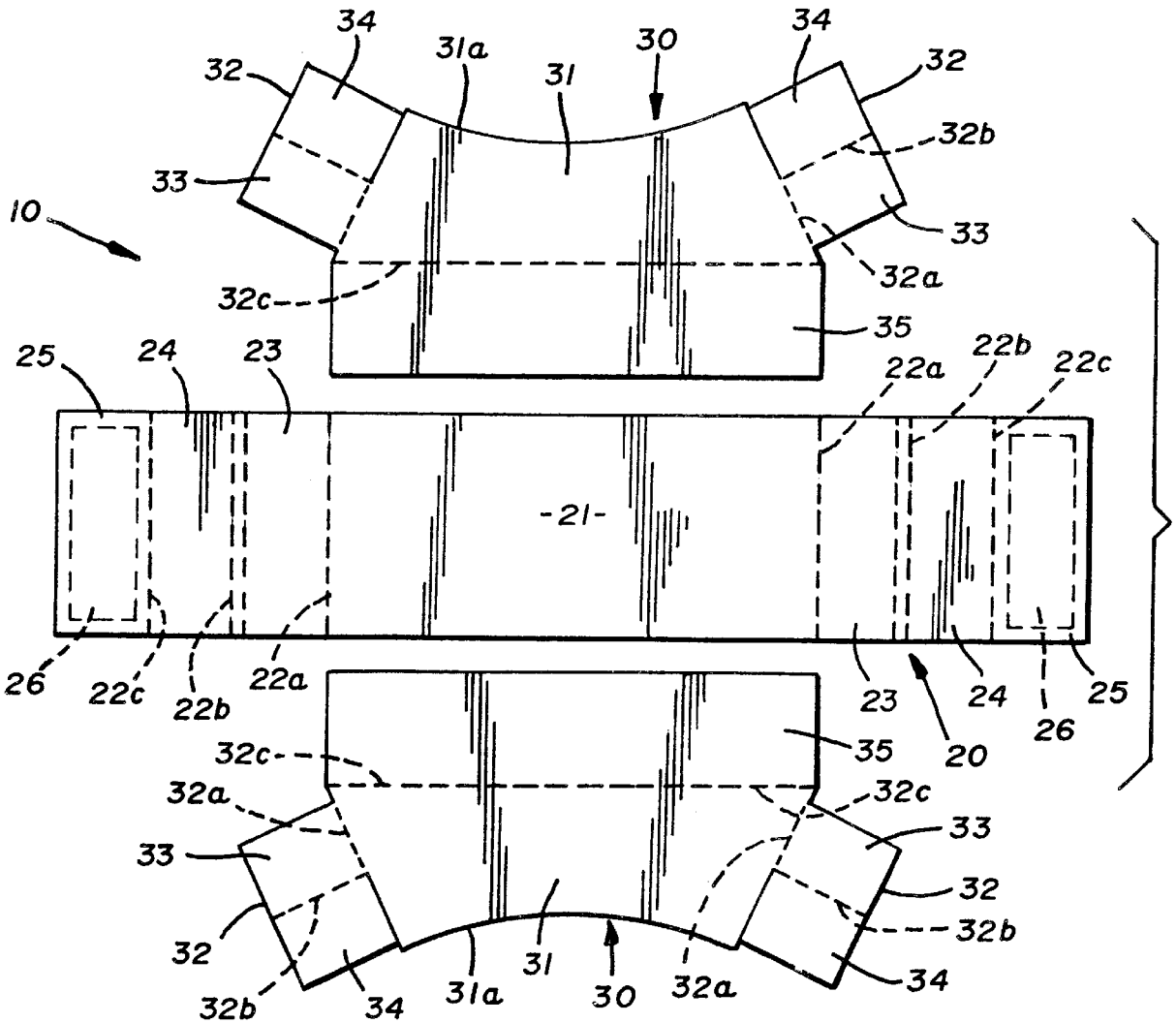
FIG. 5 is a plan view showing the blank from which the adjustable tire stand may be produced and assembled.
Figure 6:
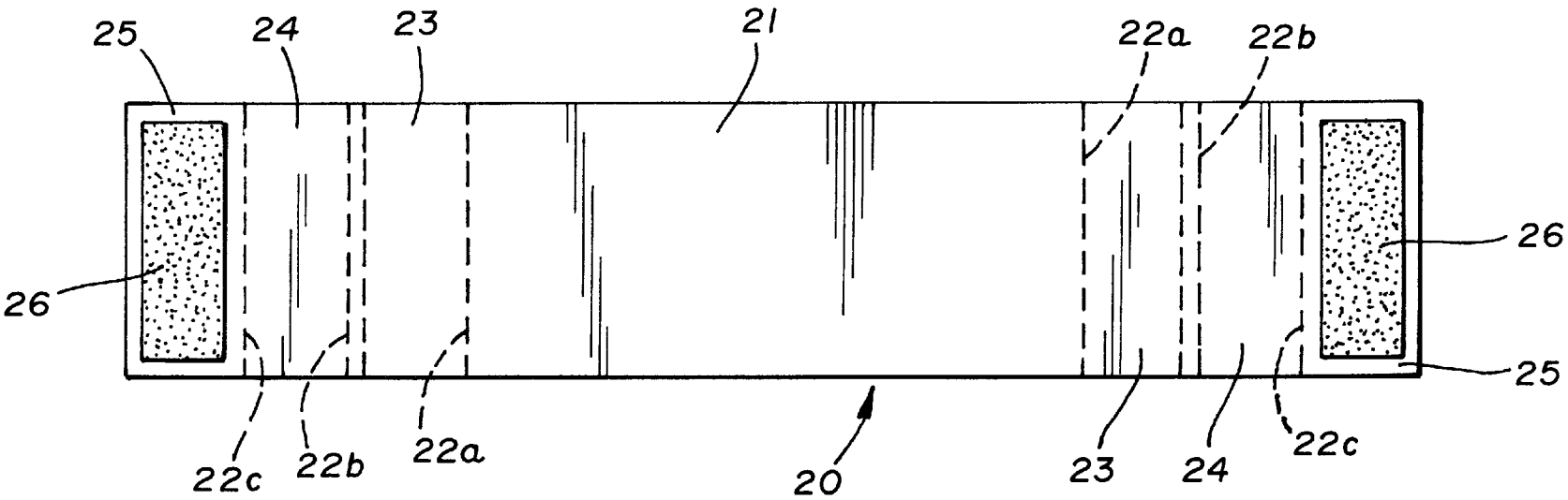
FIG. 6 is a plan view of the blank from which the adjustable tire stand may be produced taken from the reverse side thereof to that of FIG. 5.

Also, it will be noted from FIG. 5 of the drawings that a securing means 26 is provided on one surface of each third segments 25. In this fashion, once the article support members have been folded to their pyramidal position, it is possible to secure the article support members 22, 22 to the top surface 21 of the base 20. While, in that regard, the invention is not intended to be limited to any particular attachment substance or means, double backed adhesive tape has been found to be one effective expedient.

BRIEF DESCRIPTION OF THE PREFERRED EMBODIMENTS

Figure 1:
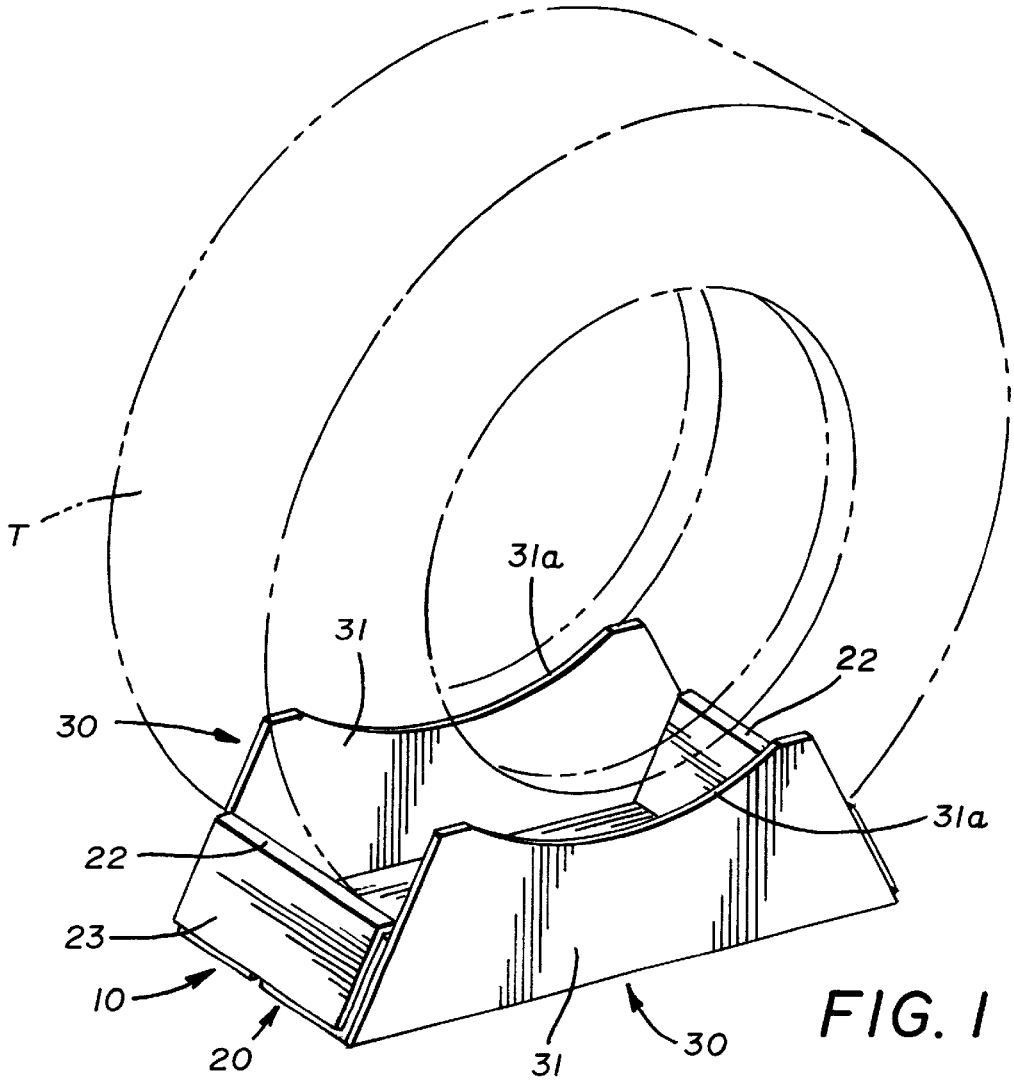
FIG. 1 is a perspective view showing the assembled tire stand with the tire shown in phantom as it would be at the point of sale.
Figure 2:
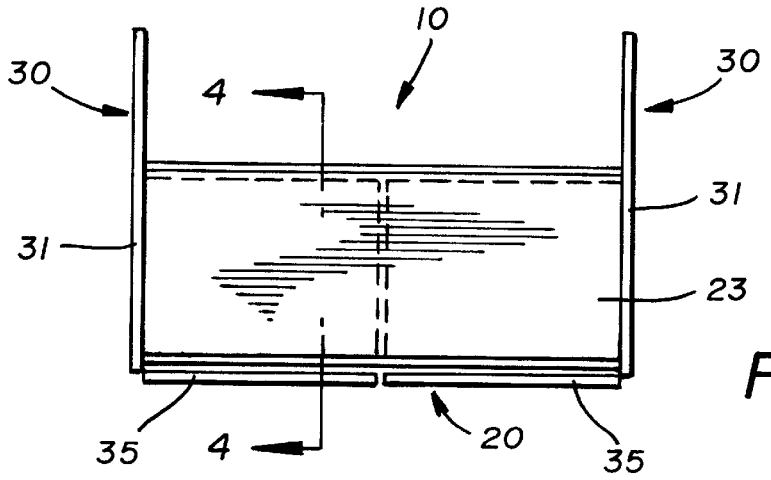
FIG. 2 is a end elevational view thereof.

Referring first to FIG. 1, it will be noted that the tire stand, generally indicated by the numeral 10, includes side support members 30, 30 and a base member 20. When the stand is assembled, the base member 20 receives the tire between the walls 31, 31 of side support members 30, 30 and prevents it from moving inadvertently either in a lateral direction against the side walls or in a radial direction off of the base.

Referring then to FIGS. 1, 2, 3 and 4 of the drawings, it will be seen that the base 20 has a flat planar surface 21 and at its opposed ends includes article support members 22, 22 against which the tread of the tire will rest when the stand 10 is assembled and the tire T is in place.

The side support members 30, 30 each have an upstanding side wall 31 with an arcuate contour at the top edge 31*a* which generally conforms to the outer peripheral shape of the tire itself when viewed in elevation.

Figure 3:
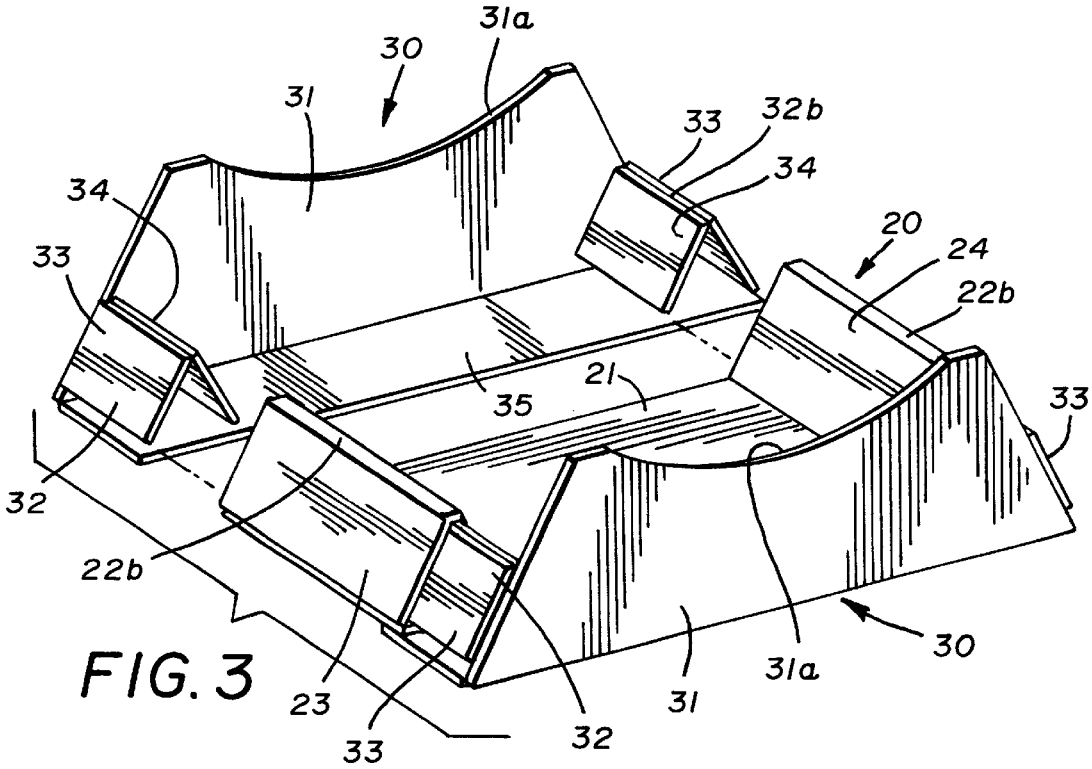
FIG. 3 is an exploded view showing the tire stand partially assembled.
Figure 4:
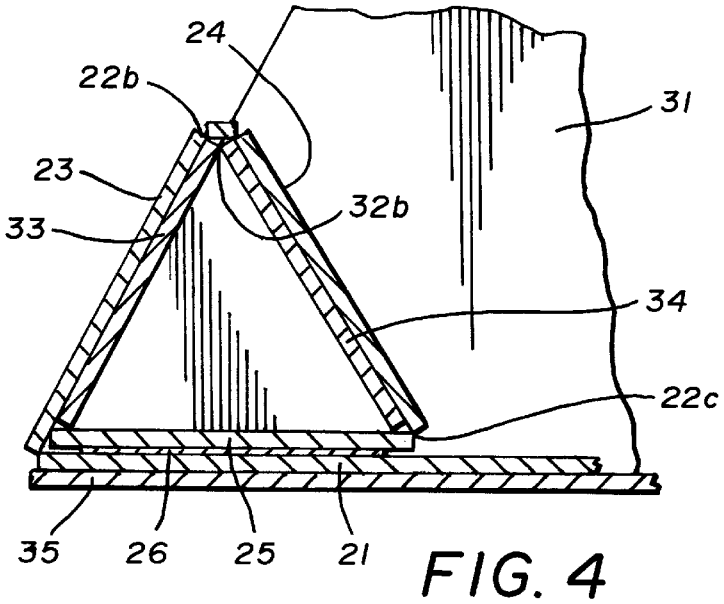
FIG. 4 is a sectional view taken along the line 2—2 of FIG. 1.

Connection means 32, 32 are received at each end of each of the side article support members 31 and, as can be seen in FIGS. 3 and 4 of the drawings, these attachment means are slidable into and out of the article support members 22, 22 of the base 20 so as, in the assembled condition such as shown in FIG. 1 of the drawings, the device presents a complete enclosure enclosing the bottom portion of the tire and can be adjusted by sliding the connection means 32, 32 relatively of the article support members 22, 22.

As previously noted, the tire stand 10 is fabricated as a blank for shipping and storage and can easily be assembled on site. Thus, with reference to FIG. 5 of the drawings, it will be seen that the tire stand is made of a planar material which can be stamped out in conventional fashion. While the invention is not intended to be limited to any particular material, it has been found that corrugated plastic made of polypropylene is one material which is strong enough to support the article when the tire is in place in the stand, but also flexible enough to permit the assembly operation which will be described below.

It will be appreciated, however, simply from a view of FIG. 5 of the drawings that shipping costs for a device of this nature are relatively minimal inasmuch as the entire stand, prior to assembly, comprises three flat blanks of relatively light weight material.

Still referring to FIG. 5 of the drawings then it will be seen, for example, that the base 20 has an elongate planar configuration. At the opposed ends thereof, first, second and third fold lines 22*a*, 22*b* and 22*c* are impressed when the blank is stamped and cut to the planar configuration of FIG. 5 of the drawings. These fold lines appear at both ends of the base. This effectively divides each end into first, second and third segments 23, 24 and 25. It will readily be seen that by folding the base along the fold lines 22*a*, 22*b*, and 22*c*, that the generally pyramidal configuration shown in FIGS. 1 and 3 of the drawing is formed. In this fashion, the article support members 22, 22 on each end of the base 20 are provided. It will be noted that these tire support members, when assembled, form, as mentioned above, a general pyramidal shape and are therefore essentially hollow from end to end for receipt of the connection means of the side article support members 30, 30 as will be described.

Also, it will be noted from FIG. 5 of the drawings that a securing means is provided on one surface of each third segments 25. In this fashion, once the article support members have been folded to their pyramidal position, it is possible to secure the article support members 22, 22 to the top surface 21 of the base 20. While, in that regard, the invention is not intended to be limited to any particular attachment substance or means, double backed adhesive tape has been found to be one effective expedient.

Still referring to FIG. 5 of the drawings, it will be seen that the opposed article support members 30, 30 are stamped and cut with a side wall 31 having an arcuate top edge and the attachment blanks 32, 32 at each end. Here again, first, second and third fold lines 32*a*, 32*b*, 32*c* are provided when the blank is stamped. This divides the attachment means at each end into two segments 33 and 34. Here again, once the score line 32*c* is broken away from the body of the side wall 31 and the blank is folded along the lines 32*a* and 32*b*, the roughly pyramidal configuration shown in FIGS. 1, 3 and 4 of the drawings will be formed.

It will be noted that no bottom wall is provided to the attachment means 32, 32. This permits the walls thereof to be pressed together or spread apart as necessary. This makes it possible to easily compress the same to slide into the article support members 22, 22. Upon release they are generally securely held in place due to their sizing and general resiliency.

Additionally, various tire widths can be readily accommodated by altering the distance the connection means are slid into the article support means.

It will be seen from the foregoing that an inexpensive, economical and effective article stand for articles such as pneumatic tires has been provided and one which, in addition to its utility once assembled, offers the advantage of being economical to produce due to the nature of the material from which it is fabricated and to ship and transport due to the nature of its material and its method of assembly.

While a full and complete description of the invention has been set forth in accordance with the dictates of the Patent Statutes, it should be understood that modifications can be resorted to without departing from the spirit hereof or the scope of the appended claims.

Thus, while certain material has been mentioned as being effective, it should be noted that any other material which has the proper strength and weight parameters or characteristics could be employed. Additionally, while a specific method of attaching the article support members at the ends of the base to the base and securing the folded ends in place has been mentioned, other suitable securing means could be employed.

What is claimed is:

1. A display apparatus for displaying an article, comprising:

a) an elongate base having a substantially planar top surface;

b) article support members projecting from said top surface at opposed ends of said base;

c) opposed side article support members each having an elongate side wall for supporting the article;

d) connection means projecting from opposed ends of each of said side walls for removable and adjustable interconnection with said article support members of said base and;

(e) said article support members of said base are hollow; and said connection means of said side article support means are sized to be slidingly received within said article support members of said base.

2. The apparatus of claim 1 wherein said base said article support members are formed from a blank of material having first, second and third fold lines at its opposed ends defining first, second and third segments which, when folded on said fold lines form generally pyramidal article support members on opposed ends of said base.

3. The display apparatus of claim 2 further characterized by the presence of securing means carried on one surface of said third segments whereby said third segments may be secured to said top planar surface of said base following folding of said blank of material.

4. The display apparatus of claim 1 or claim 2 wherein said side article support members and said connection means are formed from blanks of material each having a connection blank projecting from its opposed ends and connected thereto by a fold line; each said side article support members each having a blank having a first fold line defining first and second segments which, when folded form substantially pyramidal connection means projecting from the opposed ends of said side article support members.

* * * * *